US005159995A

United States Patent [19]

Sissala et al.

[11] Patent Number: 5,159,995

[45] Date of Patent: Nov. 3, 1992

[54] SAFETY GEAR FOR AN ELEVATOR

[75] Inventors: Mikko Sissala, Hyvinkaa; Johannes de Jong, Jarvenpaa, both of Finland

[73] Assignee: Kone Elevator GmbH, Baar, Switzerland

[21] Appl. No.: 627,599

[22] Filed: Dec. 14, 1990

[30] Foreign Application Priority Data

Dec. 18, 1989 [FI] Finland ..... 896060

[51] Int. Cl.[5] ..... B66B 5/16

[52] U.S. Cl. ..... 187/88; 187/89

[58] Field of Search ..... 187/88, 89, 90, 93, 187/86, 83, 73, 80; 188/43, 44, 72.2, 73.45, 166

[56] References Cited

U.S. PATENT DOCUMENTS 1,581,459 4/1926 Lindquist ..... 187/88
1,631,340 6/1927 Rohlfing ..... 187/88
4,819,765 4/1989 Winkler et al. ..... 187/88

FOREIGN PATENT DOCUMENTS 271384 10/1989 Japan ..... 187/88
6512490 9/1965 Netherlands ..... 187/88

*Primary Examiner*—Robert P. Olszewski
*Assistant Examiner*—Kenneth Noland

[57] ABSTRACT

A safety gear for an elevator, in which the safety gear housing is mounted on the frame using transverse bars or the like. To prevent accidental gripping of the wedges when the elevator car moves laterally, the safety gear housing is allowed to move laterally along the bars. The safety gear is provided with guiding means placed on either side of the guide rail so that the clearance between them and the guide rail is smaller than the clearance between the wedge and the guide rail. Thus, when the lateral displacements of the frame of the elevator car relative to the guide rail exceeds the distance between the guiding means and the guide rail, the safety gear housing is moved laterally and a minimum distance between the wedge and the guide rail is maintained, said minimum distance being at least equal to the difference between said clearances.

3 Claims, 3 Drawing Sheets

SAFETY GEAR FOR AN ELEVATOR

BACKGROUND OF THE INVENTION

1. Field of the Invention

The present invention relates to a safety gear designed to be mounted on an elevator car, which car moves along guide rails, said safety gear having a frame provided with one or more bars or the like placed transversely relative to the frame and a safety gear housing which can be moved laterally on said bars or the like and contains at least one wedge movable relative to the safety gear housing.

2. Description of Related Art

The motion of an elevator car is guided by roller guide shoes or sliding guide shoes moving along guide rails. The elevator is provided with safety gears, mounted e.g. on the car unit, which are activated when the elevator speed increases too much. The safety gears grip the guide rails in the hoistway. A sliding safety gear is provided with sliding surfaces having a high coefficient of friction. When the safety gear is activated, the sliding surfaces are pressed against the guide rail, retarding or stopping the elevator motion by means of friction. The sliding surfaces may consist of wedges movable in wedge housings.

For the sake of travelling comfort, the guide shoes are generally provided with relatively soft springs. The clearance between the wedges and the guide rail is usually relatively small (typically 3 . . . 5 mm). Therefore, the elastic play of the guide shoes must be less than the distance between the wedges and the guide rail to prevent accidental gripping of the safety gear. When the speed increases, a larger elastic play is required. This means that the clearance between the wedges and the guide rail should also be increased, because this clearance must always be larger than the elastic play of the guide shoes. However, a larger clearance between the wedges and the guide rail involves technically difficult and complex structures. As the wedge angle must remain within certain limits, increasing the clearance means that the wedge and the safety gear must be considerably longer. In limited spaces, this is a serious drawback.

SUMMARY OF THE INVENTION

It is an object of the present invention to eliminate the inherent disadvantages of prior safety gears and to provide an improved device provided with at least one guiding means designed to control the lateral motion of the safety gear housing in such manner that, in normal operational situations, at least a certain preset clearance between the wedge and the guide rail is maintained.

Accordingly, the invention provides a safety gear device for mounting on an elevator car which car moves along guide rails, said safety gear device comprising a frame provided with at least one transversal bar or the like, placed transversely relative to the frame, and a safety gear housing laterally displaced on said bars or the like and contains at least one wedge movable relative to the safety gear housing, wherein the safety gear is provided with at least one guiding means designed to control the lateral motion of the safety gear housing so that, in at least a certain preset clearance between the wedge and the guide rail is maintained.

In the safety gear of the invention, the elastic play of the guide shoes is independent of the clearance between the wedge and the guide rail and can therefore be set to any desired value.

BRIEF DESCRIPTION OF THE DRAWINGS

Embodiments of the invention will now be described, by way of example, with reference to the accompanying drawings, in which.

DESCRIPTION OF THE PRIOR AND PREFERRED EMBODIMENTS

Figure 1:
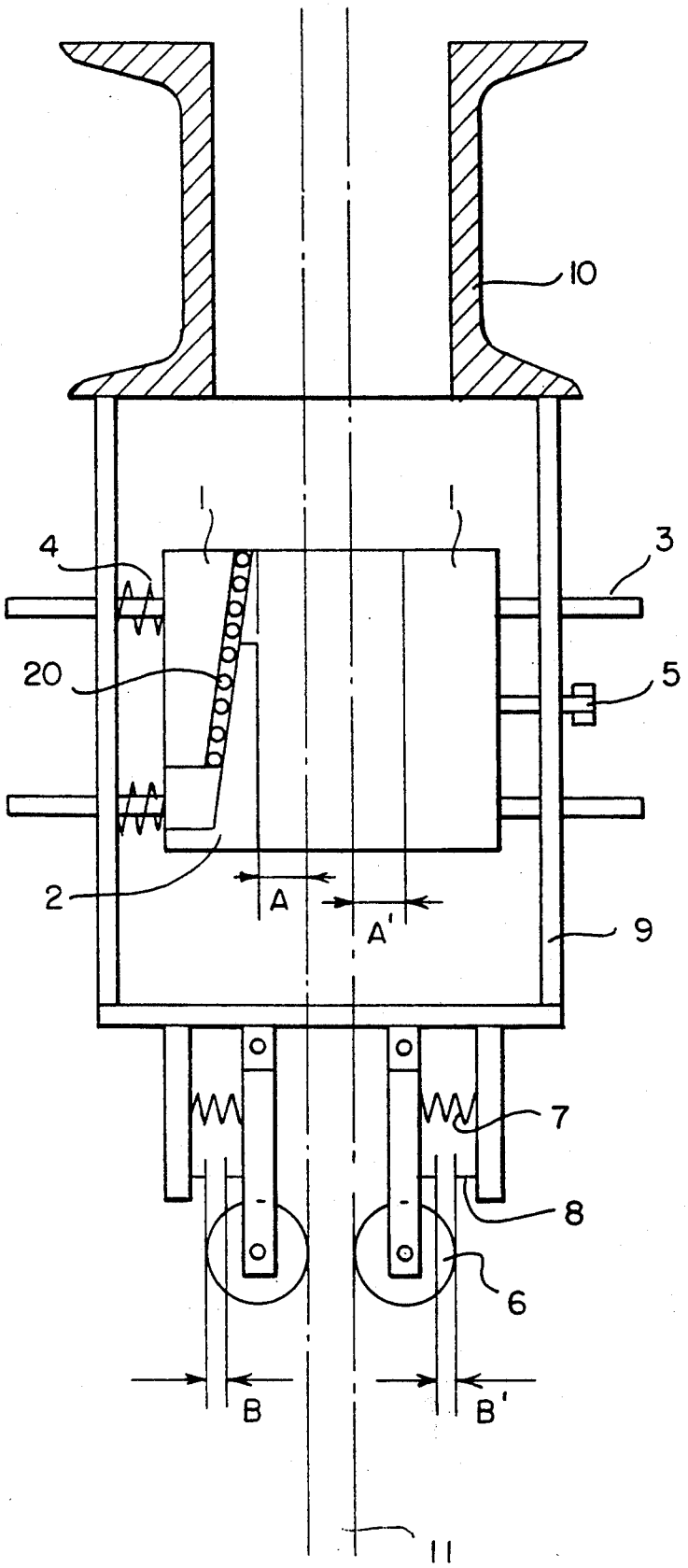
FIG. 1 illustrates a front view of a conventional safety gear.

In the previously known solution shown in FIG. 1, the safety gear unit is attached to the bottom beam 10 of the car frame. The unit comprises a safety gear housing 1 in which a wedge 2 moves along a guide surface 20. The safety gear unit is supported by guide bars 3 which are provided with centering springs placed on one side of the safety gear housing. On the opposite side a screw 5 for the adjustment of the position of the housing is provided. The guide shoe consists of guide rollers 6, guide springs 7 and limit stops 8 on each side of the guide rail 11. The safety gear has a frame 9, and the guide bars 3 pass through the frame. The wedges are separated from the guide rail by a clearance A, A'. The adjustable elastic play of the guide shoe is B, B'.

The action of a conventional safety gear is described below (e.g. when the car moves downwards). When the speed of the elevator car increases too much, the overspeed governor (not shown) is activated and causes the wedge 2 of the safety gear to move upwards. As the wedge housing moves downwards with the elevator car, the braking surface of the wedge grips the guide rail and the wedge continues moving upwards in relation to the wedge housing. Therefore, the wedge housing is forced to move left as seen in FIG. 1. As a result of this lateral motion, the braking surface of the wedge on the opposite side touches the guide rail and both wedges continue moving upwards in relation to the wedge housing, which in turn continues moving left until it reaches the set limit. After the safety gear action, the wedge housing returns to the original position.

Figure 2:
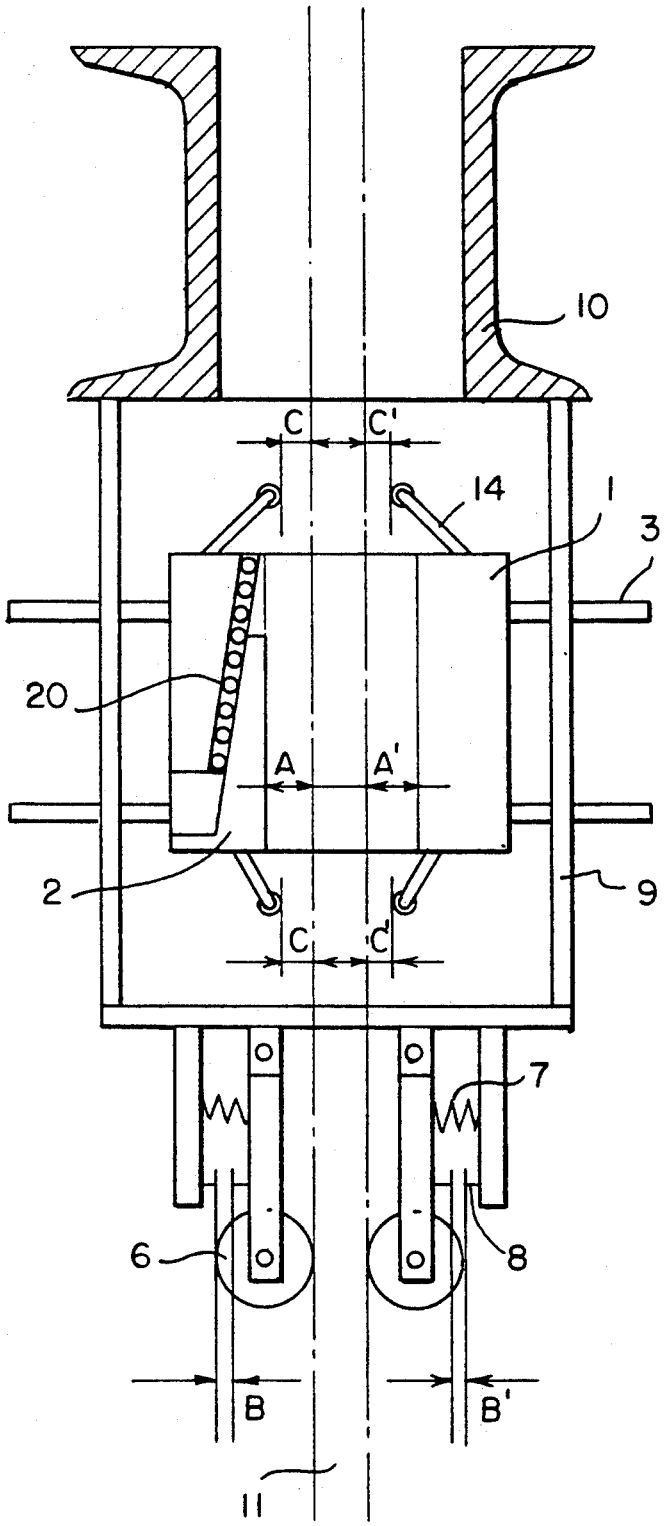
FIG. 2 illustrates a front view of the safety gear of the invention.

In the safety gear system of the invention (FIGS. 2 and 3), the safety gear housing can move in a transverse plane relative to the elevator car frame. In the solution presented in FIG. 2, this motion is guided by transverse horizontal bars 3 and fixed-position guiding means 14 provided on both sides of the guide rail. The guiding means 14, which have rollers at their ends, limit the clearance C, C' between the roller and the guide rail so that it is narrower than clearance A, A', thus preventing the wedge 2 from touching the guide rail during normal operation. A special case is a situation where C=0, i.e. the wedge housing continuously follows the contour of the guide rail. As stated above, the value of the elastic play B is not any more limited by clearance A.

If the motion of the car frame relative to the guide rail exceeds the value of C, the safety gear housing 1, pushed by the guiding means 14, will move laterally along the guide bars 3 so that the minimum clearance between the safety gear wedges and the guide rail remains at the value A−C. Thus, clearance A no longer limits the elastic play B.

Figure 3:
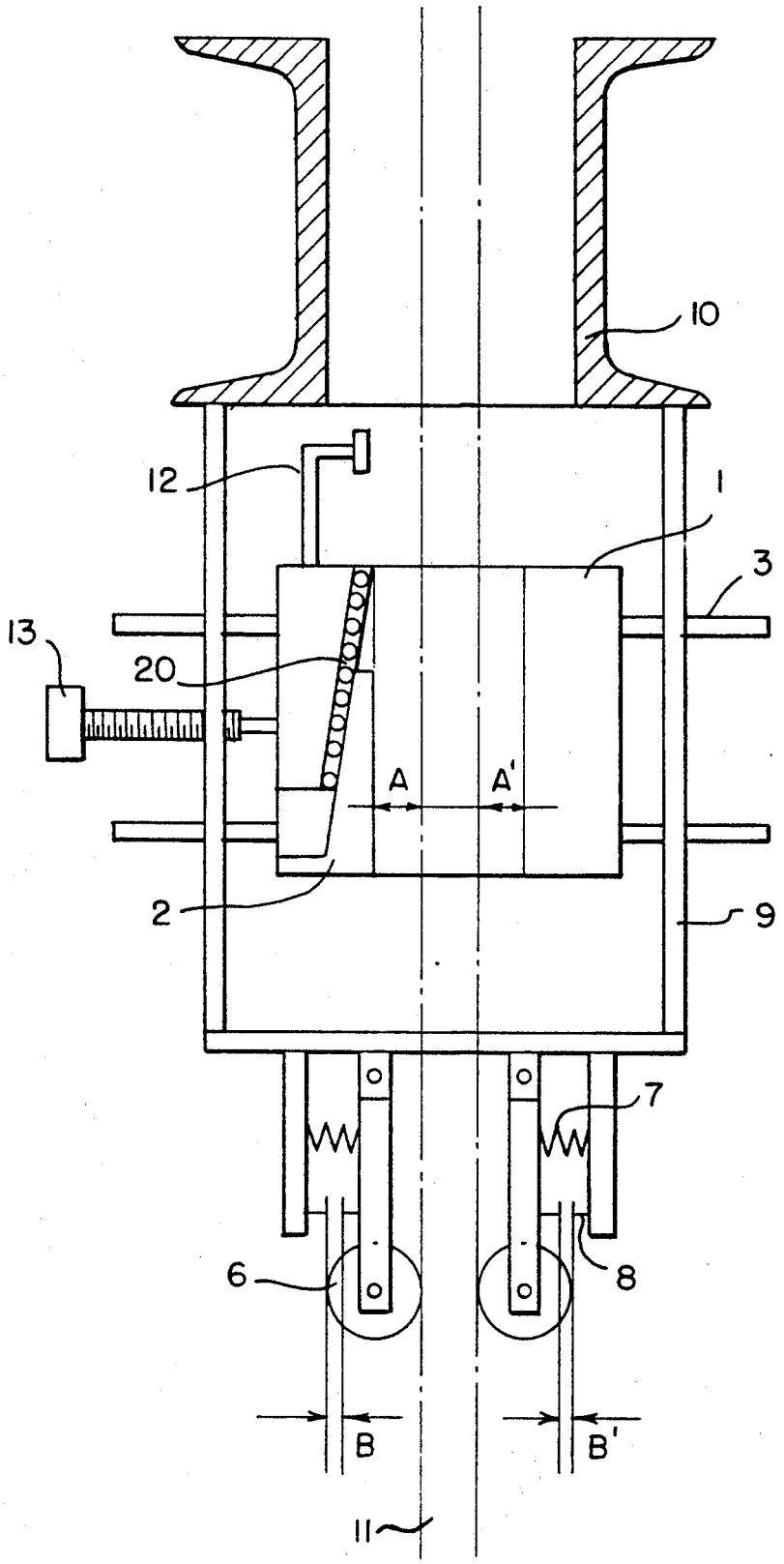
FIG. 3 illustrates a front view of another embodiment of the invention.

FIG. 3 represents a system in which the invention is implemented using a servo drive. In this solution, a detector 12 placed in the safety gear housing measures the distance between the housing 1 and the guide rail and controls a servo actuator 13 which maintains a practically constant clearance A by moving the safety gear housing until the right clearance is reached. Therefore, the guiding means 14 are no longer necessary for this embodiment.

It is obvious to a person skilled in the art that different embodiments of the invention are not restricted to the examples described above, but that they may instead be varied within the scope of the following claims. For instance, the guiding means 14 are not necessarily fixedly mounted but may instead have some elastic play, implemented e.g. using springs. In addition, the guiding means may be so designed that their position can be adjusted as required, either manually or automatically.

We claim:

1. A safety gear device for mounting on an elevator car, which car moves along guide rails, said safety gear device comprising:

a frame provided with at least one transversal bar, placed transversely relative to the frame;

a safety gear housing, laterally displaceable on said at least one transversal bar and containing at least one wedge movable relative to said safety gear housing; and guiding means for controlling the lateral motion of said safety gear housing so that at least a certain preset clearance between the wedge and the guide rail is maintained;

said guiding means being placed on said safety gear housing symmetrically on either side of the guide rail in such manner that, in a normal operational situation, the clearance between said guiding means and the guide rail is smaller than the clearance between the wedge and the guide rail, thereby maintaining an essentially constant minimum distance between the wedge and the guide rail;

said guiding means contacting the guide rail and causing said safety gear housing to move transversely along said at least one transversal bar in the opposite direction relative to the lateral displacement of the elevator car when the elevator car is laterally displaced.

2. A safety gear device for mounting on an elevator car, which car moves along guide rails, said safety gear device comprising:

a frame provided with at least one transversal bar placed transversely relative to said frame;

a safety gear housing, laterally displaceable on said at least one transversal bar and containing at least one wedge movable relative to said safety gear housing; and guiding means for controlling the lateral motion of said safety gear housing so that at least a certain preset clearance between the wedge and the guide rail is maintained:

said guiding means being placed on said safety gear housing symmetrically on either side of the guide rail in such manner that, in a normal operational situation, the clearance between said guiding means and the guide rail is smaller than the clearance between the wedge and the guide rail, thereby maintaining an essentially constant minimum distance between the wedge and the guide rail;

said guiding means contacting the guide rail and causing said safety gear housing to move transversely along said at least one transversal bar in the opposite direction relative to the lateral displacement of the elevator car when the elevator car is laterally displaced;

said guiding means being provided at a free end of said guiding means with a roller which contacts the guide rail as a result of the lateral displacement of the elevator car.

3. A safety gear device for mounting on an elevator car, which car moves along guide rails, said safety gear device comprising:

a frame provided with at least one transversal bar, place transversely relative to said frame;

a safety gear housing, laterally displaceable on said at least one transversal bar and containing at least one wedge movable relative to said safety gear housing;

guiding means for controlling the lateral motion of said safety gear housing so that at least a certain preset clearance between the wedge and the guide rail is maintained; and said guiding means consisting of a detector attached to said safety gear housing for measuring the distance between said safety gear housing and the guide rail;

a servo actuator, controlled by said detector, for moving said safety gear housing according to the measurement obtained by said detector in such manner that the clearance between the wedge and the guide rail remains essentially constant.

* * * * *